US005954564A

United States Patent [19]

Ganz

[11] Patent Number: 5,954,564

[45] Date of Patent: Sep. 21, 1999

[54] UNDERGARMENT WITH NATURAL FEELING BUTTOCK SUPPORT

[75] Inventor: Nancy Ganz, New York, N.Y.

[73] Assignee: Warnaco, Inc., New York, N.Y.

[21] Appl. No.: 08/450,550

[22] Filed: May 25, 1995

[51] Int. Cl.[6] ..... A41B 9/00; A41C 1/02; A41C 1/12

[52] U.S. Cl. ..... 450/99; 450/98; 450/100; 450/106; 450/107; 450/115; 450/117; 450/122; 2/73

[58] Field of Search ..... 2/73, 400, 401, 2/402, 403, 406; 450/82, 95, 98, 99, 115, 116, 117, 118, 122, 123, 124, 125, 126, 127, 128, 129, 130, 131, 132, 100, 106, 407, 109, 108, 110

[56] References Cited

U.S. PATENT DOCUMENTS

| | | | |
|---|---|---|---|
| 1,494,044 | 5/1924 | Ward et al. . | |
| 2,171,913 | 9/1939 | Bullinger | 450/130 X |
| 2,288,553 | 6/1942 | Slezak . | |
| 2,332,141 | 10/1943 | Greene . | |
| 2,341,882 | 2/1944 | Scriggins | 450/130 X |
| 2,344,374 | 3/1944 | Stephens | 450/130 X |
| 2,641,257 | 6/1953 | Rutledge . | |
| 2,792,698 | 5/1957 | Hampp . | |
| 2,803,822 | 8/1957 | Doyle | 450/130 |
| 2,898,918 | 8/1959 | Roura et al. . | |
| 2,908,277 | 10/1959 | Peck | 450/130 X |
| 2,971,515 | 2/1961 | Geismann | 450/118 |
| 2,982,287 | 5/1961 | Paveza | 450/118 |
| 3,080,869 | 3/1963 | Alberts | 450/118 |
| 3,130,730 | 4/1964 | Zanca | 450/11 X |
| 3,228,401 | 1/1966 | Byrne . | |
| 3,283,759 | 11/1966 | Welsch et al. . | |
| 3,312,981 | 4/1967 | McGuire et al. . | |
| 3,339,554 | 9/1967 | Nobbs | 450/99 X |
| 3,375,829 | 4/1968 | Brennan et al. . | |
| 3,401,699 | 9/1968 | Shea | 450/116 X |
| 3,489,154 | 1/1970 | Kaspar et al. . | |
| 3,909,847 | 10/1975 | Holt et al. . | |
| 4,390,999 | 7/1983 | Lawson et al. . | |
| 4,476,895 | 10/1984 | Shibusawa . | |
| 5,255,393 | 10/1993 | Brady . | |

FOREIGN PATENT DOCUMENTS

| | | |
|---|---|---|
| 64826 | 12/1995 | France . |

*Primary Examiner*—Jeanette E. Chapman
*Attorney, Agent, or Firm*—Amster, Rothstein & Ebenstein

[57] ABSTRACT

A body shaping undergarment is disclosed. A plurality of fabric panels are fixed together to form the undergarment and define a first leg opening, a second leg opening and a waist opening. An elastic waist band is disposed around at least a portion of the circumference of the waist opening, and a first and a second elastic leg band are respectively disposed around at least a portion of a circumference of the first leg opening and the second leg opening. A pair of elastic buttock support panels are fixed to the undergarment and disposed so that each elastic buttock support panel elastically supports a respective buttock of a wearer. The pair of elastic buttock support panels is integrally fixed to a same fabric panel of the plurality of fabric panels, and each one of the pair of elastic buttock support panels is integrally fixed to a respective same fabric panel of the plurality of fabric panels as a the first elastic leg band and the second elastic leg band. Thus, the pair of elastic buttock support panels and the first elastic leg band and the second elastic leg band co-act to lift and support the buttocks of the wearer, thereby shaping and firming the midsection of the wearer.

15 Claims, 7 Drawing Sheets

UNDERGARMENT WITH NATURAL FEELING BUTTOCK SUPPORT

TECHNICAL FIELD

The present invention pertains to undergarments worn around the waist, hips, buttocks and thighs of a wearer. In particular, the present invention pertains to an undergarment for firming and shaping the tummy, thighs, hips and buttocks of the wearer.

BACKGROUND

A conventional undergarment, such as a panty or brief, is comprised of a number of fabric panels sewn together to form an undergarment having two leg openings and a waist opening. The undergarment is worn by slipping each of the legs of the wearer through the waist opening and through a respective leg opening. The undergarment is then pulled up the legs and disposed so as to cover the waist, hips, buttocks and thighs of the wearer. Traditionally, elastic material may be sewn to the undergarment at the circumference of the waist opening and/or leg openings to provide a snug, flexible fit of the garment on the body of the wearer.

Generally, the elastic material consists of a light, thin elastic band sewn to the undergarment at the circumference of the waist opening and/or leg openings, and is very easily stretched to conform to the body of the wearer and to allow for comfort and ease of movement. The elastic material provides very little support, and is usually ineffective for shaping and firming the body of the wearer. Also, the material used for the fabric panels is usually relatively light weight and non-supportive of the body of the wearer.

Body-shaping undergarments have been designed to satisfy the desire of a wearer to present a firm and shapely figure. A conventional body-shaping undergarment is exemplified by a corset. A corset is a shaped, close-fitting, usually reinforced undergarment worn to shape and support the body of the wearer. A conventional body-shaping undergarment typically utilizes stiff and overly-constraining reinforcing components and straps, making the garment clumsy, uncomfortable and severely restrictive of the movement of the wearer.

FIGS. 6 and 7 show a prior attempt at providing a body-shaping undergarment that is comfortable to wear and not overly restrictive. This body-shaping undergarment comprises a plurality of fabric panels sewn together to define waist opening 1 and leg openings 2. The circumference of the waist opening 1 is bordered by an elastic waist band 3, which is designed to support and firm the midsection of the wearer. The circumference of each leg opening 2 is bordered by a thin elastic leg band 4 for drawing the leg openings 2 of the garment close around the thighs of the wearer. A pair of straps 5 are fixed to the front and back of each leg opening 2, and each strap 5 terminates in a fitting for attachment to hosiery worn by the wearer. As shown in FIG. 7, a pair of buttock support panels 6 are disposed at the back-side of the undergarment. Each buttock support panel 6 supports and shapes a respective buttocks of the wearer, and a large gap 7 is present between the buttock support panels 6 with no fabric panel existing to cover the buttock of the wearer.

The undergarment shown in FIGS. 6 and 7 suffers from a number of drawbacks that makes it less than effective to adequately shape and firm the body of the wearer. For example, the thin elastic leg bands 4 provide very little support to the thighs of the wearer. Also, the large gap 7 between the buttock support panels 6 reduces the comfort of the wearer, requiring the use of an additional undergarment, such as a panty, to adequately cover the buttocks of the wearer. Also, due to the large gap 7, and the inability of the thin elastic leg bands 4 to adequately support the thighs of the user, the undergarment lacks the co-action between the leg bands 4, buttock support panels 6 and waist band 3 that is necessary to effectively shape and support the mid-section of the wearer.

There have been a variety of attempts to provide a body-shaping undergarment capable of shaping and supporting the body of the wearer. For example, U.S. Pat. No. 5,255,393, issued to Brady, discloses a form fitting undergarment to be worn by pregnant women or women with large abdomens. To accommodate a large abdomen, this reference teaches the use of a front panel made of a stretchable material that is more stretchable than to other fabric panels making up the undergarment. This prior attempt fails to adequately constrain and support the mid-section of the wearer, and is thus ineffective at providing a firmer, more shapely figure. Also, U.S. Pat. No. 4,390,999, issued to Lawson et al., discloses a panty hose type garment having a body bulge controlling portion. The body bulge controlling portion is provided so that a compressive force exerted by the garment against the body is varied in a stepped manner. This prior attempt does also fails to adequately constrain and support the waist and mid-section of the wearer, and thus fails to provide a body-shaping undergarment that is comfortable to wear and effective at firming and shaping the mid-section of the wearer.

SUMMARY OF THE INVENTION

The present invention overcomes the drawbacks of the conventional art by providing a body shaping undergarment for firming and shaping the tummy, thighs, hips and buttocks of the wearer.

In accordance with the inventive undergarment, a plurality of fabric panels are fixed together to form an undergarment having a front and a back. The plurality of fabric panels define a first leg opening, a second leg opening and a waist opening. An elastic waist-band is disposed around at least a portion of the circumference of the waist opening. A first and a second elastic leg-band are respectively disposed around at least a portion of a circumference of the first leg opening and the second leg opening. A pair of elastic buttock support panels are fixed to the undergarment and disposed so that each elastic buttock support panel elastically supports a respective buttock of the wearer. Each elastic buttock support panel comprises a first section disposed at the back of the garment and oriented having a longitudinal direction extending substantially from the waist opening and towards a respective leg opening. A second section of the buttock support panel extends from an end of the first section closest to the leg opening and at a downward sloping angle towards a symmetrical center-line of the garment. The pair of elastic buttock support panels are integrally fixed to a same central fabric panel of the plurality of fabric panels so that the pair of elastic buttock support panels co-act to lift and support the buttocks of the wearer.

In accordance with the preferred embodiment of the inventive undergarment, the fabric panels comprise an elastic material capable of supporting and firming the body of the wearer, while allowing for comfort and a high degree of freedom of movement.

In accordance with the preferred embodiment of the inventive undergarment, the first and second elastic leg-band each comprise a wider elastic leg section disposable during use for elastically confining substantially an inner and a back portion of a respective thigh of a wearer. The first and second elastic leg-band further comprise a thinner elastic leg section disposable during use for elastically confining substantially a side portion of the respective thigh of the wearer. By this construction, the thighs of the wearer are suitably firmed, while allowing for a high degree of movement and comfort during use.

Each of the pair of elastic buttock support panels is disposed at the back of the garment and oriented having a longitudinal direction extending substantially from the waist opening towards a respective leg opening. Each of the pair of elastic buttock support panels comprises an elastic fabric having a stretching direction along the longitudinal direction, and a non-stretching direction perpendicular to the longitudinal direction. Thus, the pair of elastic buttocks support panels are effective to shape the wearer by elastically supporting the buttocks in the stretching direction, and constrainingly supporting the buttocks in the non-stretching direction. Each of the elastic buttock support panels is fixed to the elastic waist-band so that the elastic waist-band also supports the buttocks through the elastic buttock support panels.

BRIEF DESCRIPTION OF THE DRAWINGS

One way of carrying out the invention is described in detail below with reference to drawings which illustrate only one specific embodiment of the invention and in which.

DETAILED DESCRIPTION OF THE PREFERRED EMBODIMENTS

Figure 1:
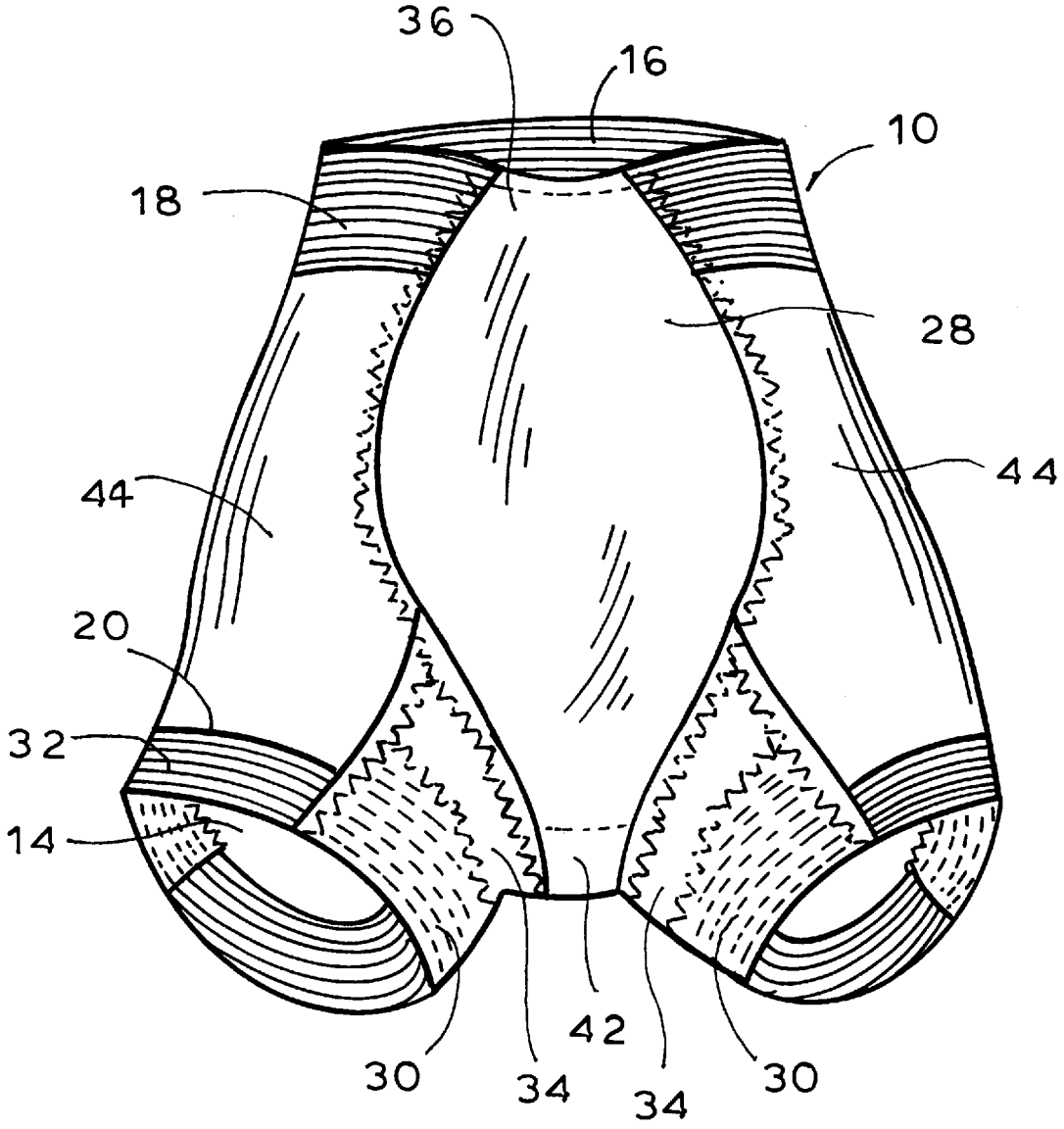
FIG. 1 is a front perspective view of the inventive Body Shaping Undergarment.
Figure 2:
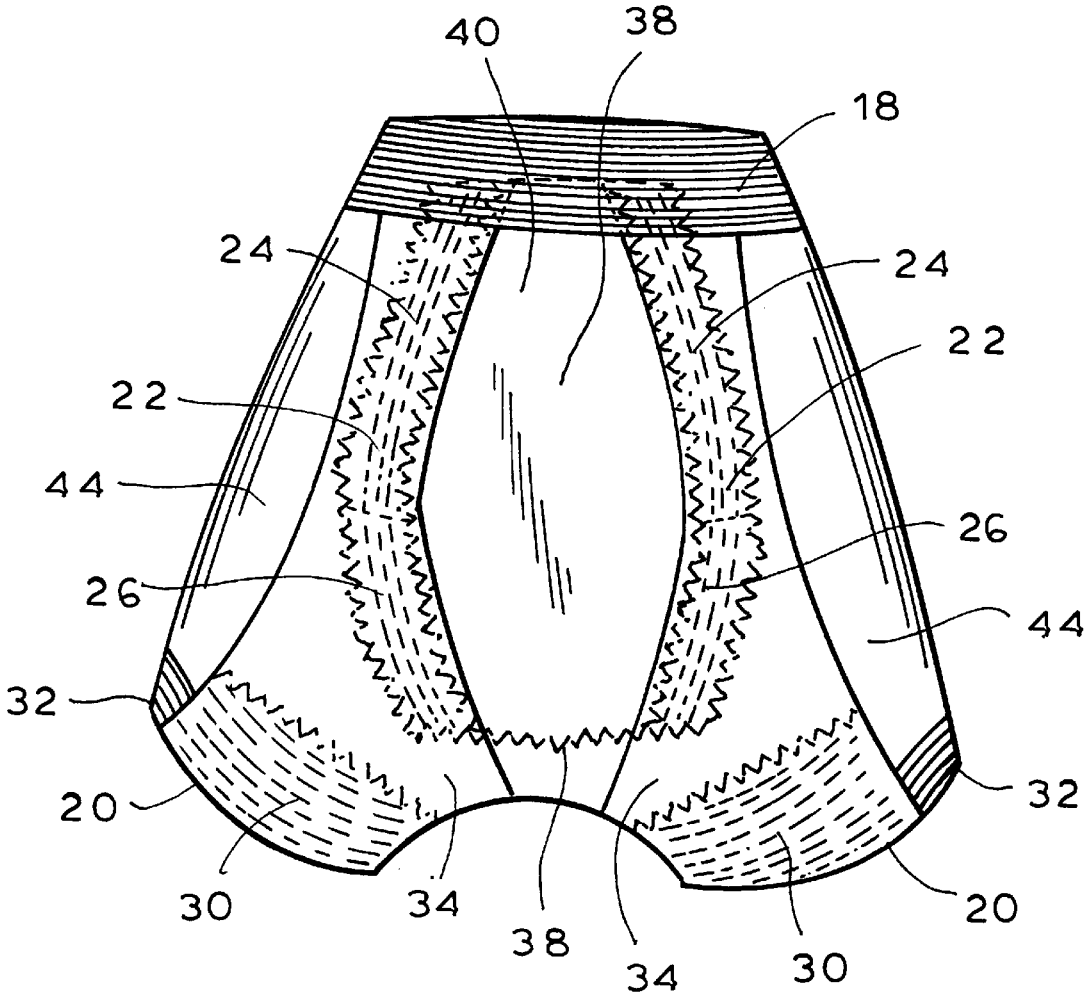
FIG. 2 is a rear perspective view of the inventive Body Shaping Undergarment.
Figure 3:
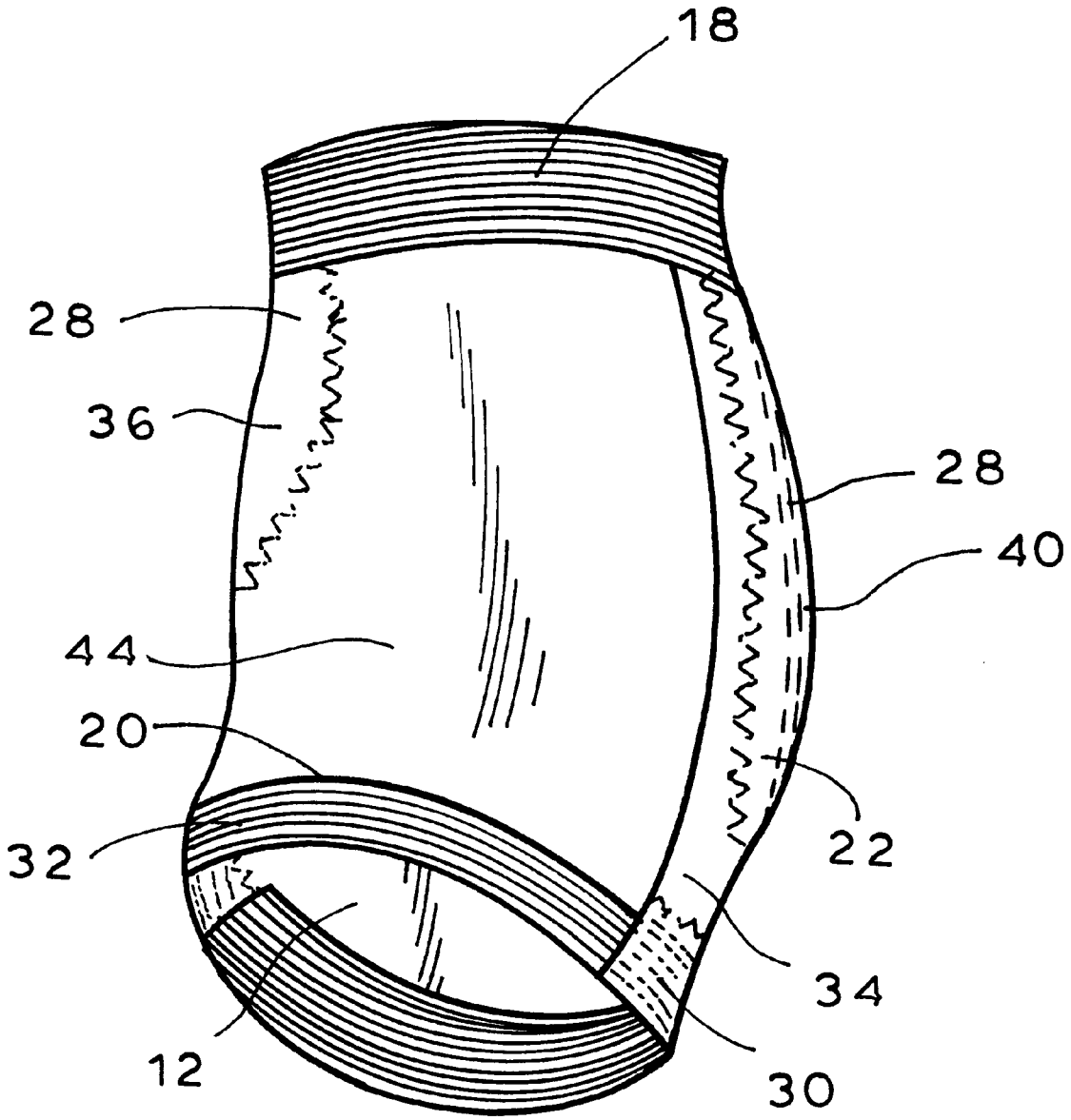
FIG. 3 is a side perspective view of the inventive Body Shaping Undergarment.

Referring to FIGS. 1–3, an embodiment of the inventive Body Shaping Undergarment is shown. In accordance with the invention, a plurality of fabric panels are fixed together to form an undergarment 10. The undergarment 10 defines a first leg opening 12, a second leg opening 14 and a waist opening 16. In use, the undergarment 10 is worn by a user in a similar manner as the wearing of a pair of pants or shorts. An elastic waist-band 18 is disposed around at least a portion of the circumference of the waist opening 16. When the inventive undergarment 10 is worn by a user, the elastic waist-band 18 exerts a squeezing force around the tummy of the user, thereby shaping the tummy and giving the appearance of a slimmer figure. A first and a second elastic leg-band 20 are respectively disposed around at least a portion of the circumference of the first leg opening 12 and the second leg opening 14. The elastic leg-bands 20 apply a squeezing force to the thighs of the wearer, helping to shape the thighs and present a slimmer appearance.

As shown in FIGS. 2 and 3, a pair of elastic buttock support panels 22 are fixed to the undergarment and disposed so that each elastic buttock support panel 22 elastically supports a respective buttock of the wearer. Each elastic buttock support panel 22 is configured and dimensioned to lift and support the respective buttock of the wearer. Thus, when the inventive undergarment 10 is worn, the elastic waist-band 18 acts to slim the tummy of the user, the elastic leg-bands 20 act to slim the thighs of the user, and the elastic buttock support panels 22 act to lift and support the buttocks of the wearer, thereby giving a shapely, trimmer appearance to the body of the wearer. The elastic waist-band 18, elastic leg-bands 20 and elastic buttock support panels 22 co-act to shape the midsection of the wearer, thereby allowing a more desirable body shape to be obtained.

In accordance with the preferred embodiment of the invention, the plurality of fabric panels comprise an elastic fabric, and in particular, utilize an elastic fabric comprised of 59% dull antron nylon, 23% mid-dull antron nylon and 18% dull lycra. The lycra give support and stretch to the fabric panels making up the inventive undergarment 10, thereby co-acting with the elastic waist-band 18, elastic leg-bands 20 and elastic buttock support panels 22 to firm and shape the thighs, hips, tummy and buttocks of the wearer.

In accordance with the preferred embodiment, each elastic buttock support panel 22 is disposed at the back of the undergarment 10, and oriented having a longitudinal direction. The longitudinal direction extends substantially from the waist opening 16 towards a respective leg opening 12, 14. Each elastic buttock support panel 22 comprises an elastic fabric having a stretching direction along the longitudinal direction, and a non-stretching direction perpendicular to the longitudinal direction. Thus, the pair of elastic buttock support panels 22 are effective during use to shape the buttocks of the wearer by elastically supporting each buttock in the stretching direction and constrainingly supporting the buttock in the non-stretching direction.

Furthermore, each of the pair of elastic buttock support panels 22 comprises a first section 24 disposed at the back of the undergarment 10 and oriented having a longitudinal direction extending substantially from the waist opening 16 and towards a respective leg opening 12, 14. A second section 26 extends from an end of the first section 22 closest to the leg opening 12, 14 and slopes towards a symmetrical center-line of the undergarment 10. Thus, as shown in FIG. 2, the pair of buttock support panels 22 are constructed and disposed so as to be effective to lift and support the buttocks of the wearer. By this configuration, a loose and flabby buttocks of a wearer is firmed and shaped so as to present a more desirable appearance. Furthermore, in accordance with the preferred embodiment, a first end of each of the pair of elastic buttock support panels 22 is fixed to the elastic waist-band 18 so that the elastic waist-band 18 supports each respective buttock through a corresponding elastic buttock support panel 22. In this way, the elastic waist-band 18 and the elastic buttock support panel 22 co-act to lift and shape the buttocks of the wearer. Also, in accordance with the preferred embodiment, the pair of elastic buttock support panels 22 are integrally fixed to a same central fabric panel 28 of the plurality of fabric panels so that the pair of elastic buttock support panels 22 co-act to lift and support the buttocks of the wearer.

Figure 4:
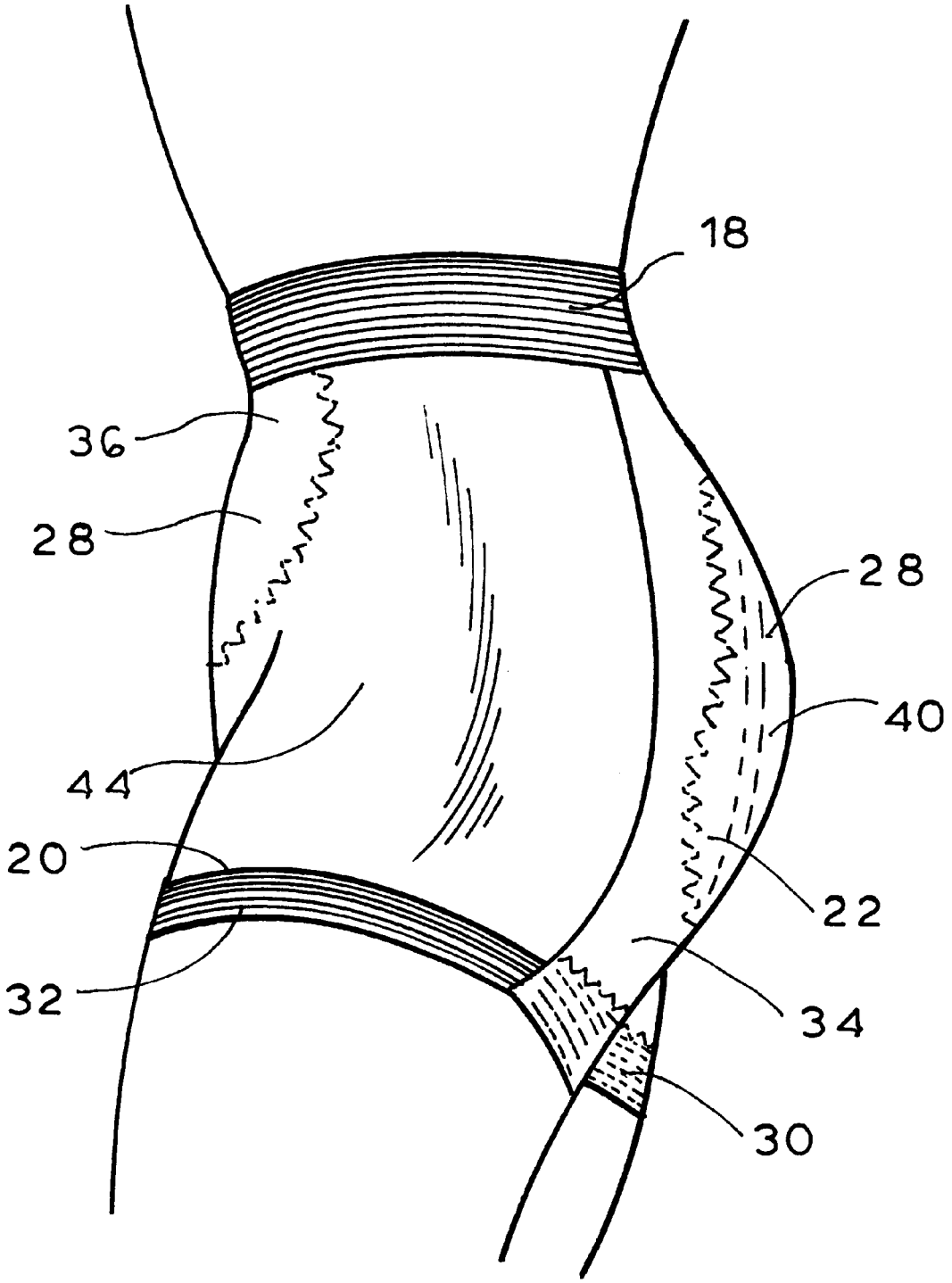
FIG. 4 is an illustration showing the inventive Body Shaping Undergarment in use.

As shown in FIG. 4, when the inventive undergarment 10 is worn by the wearer, the elastic waist-band 16 squeezes and firms the tummy of the wearer, thus flattening the tummy, while giving support to the back of the wearer to help improve the overall posture of the wearer. The elastic buttock support panels 22 are elastically stretched by the wearer, so that a loose and flabby buttocks is lifted and supported to tighten and firm the buttocks. The stretch direction of the elastic buttock support panels ensures that the wearer remains comfortable when walking, sitting, standing, etc. The first and the second elastic leg-band 20 each comprise a wider elastic leg section 30 disposable during use for elastically confining substantially an inner and back portion of a respective thigh of the wearer. A thinner elastic leg section 32 is disposable during use for elastically confining substantially a side portion of the respective thigh of the wearer. Thus, in accordance with this aspect of the invention, the inner and back portion of the thighs of the wearer are amply supported and firmed by the wider elastic leg section 30, while the thinner elastic leg section 32 promotes comfort and freedom of movement.

Referring to FIGS. 1–4, in the preferred embodiment, the pair of elastic buttock support panels 22 are integrally fixed to a same central fabric panel 28, and also integrally fixed to a respective same fabric panel as at least a portion of the corresponding first or second elastic leg-band 20. In the embodiment shown, each elastic buttock support panel 22 is integrally fixed to a corresponding leg fabric panel 34 and the respective wider elastic leg section 30 is also fixed to this same leg fabric panel 34. Thus, the pair of elastic buttock support panels 22 and the first and second elastic leg-bands 20 co-act to lift and support the buttocks of the wearer. Therefore, in accordance with the present invention, the elastic waist-band 18, the elastic buttock support panels 22, the elastic leg-bands 20, and the elasticity of the fabric panels all co-act to provide a more shapely and firmer appearance of the wearer's thighs, hips, buttocks and tummy.

Figure 5:
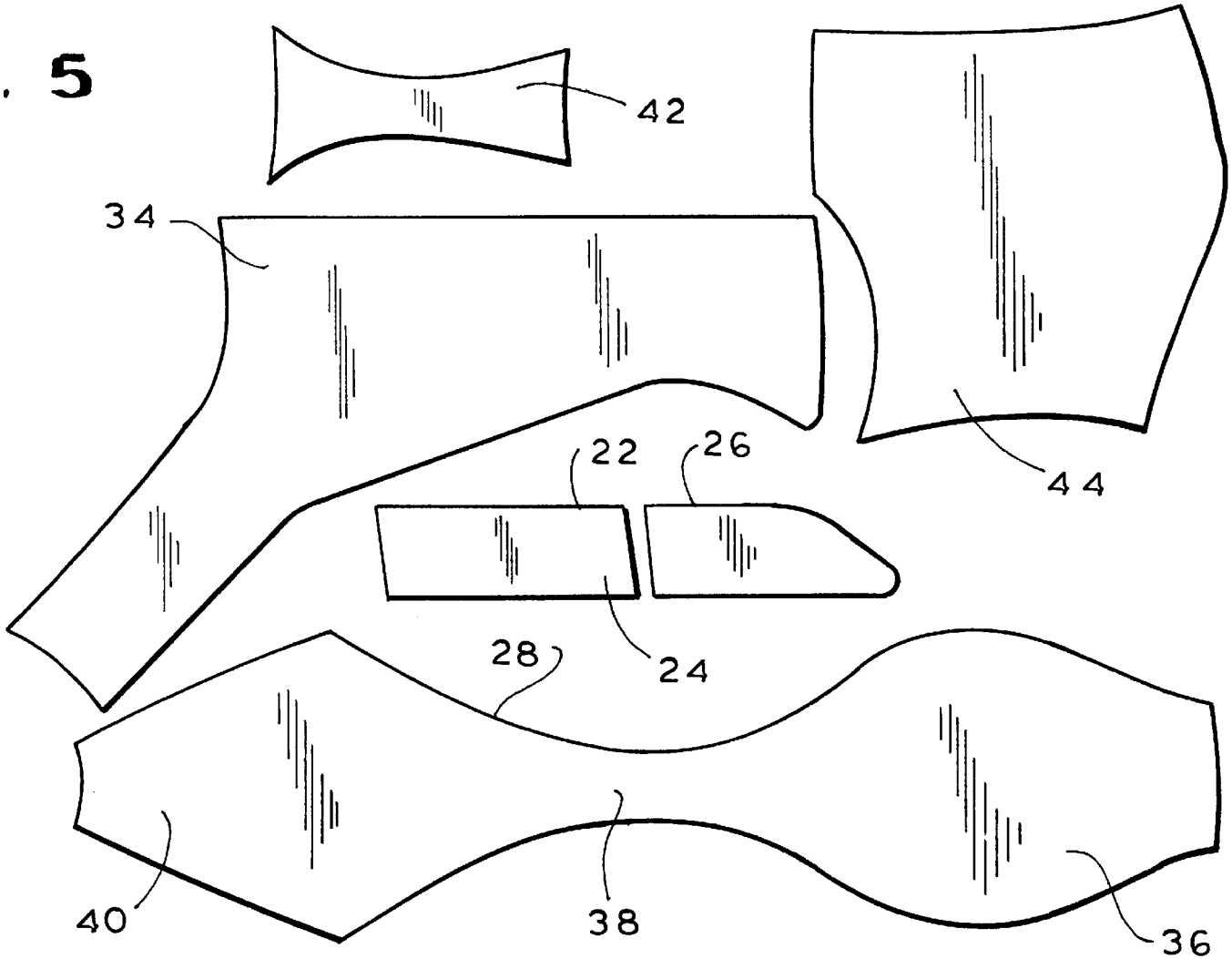
FIG. 5 is a plan view of splayed-out fabric panels comprising the inventive Body Shaping Undergarment.
Figure 6:
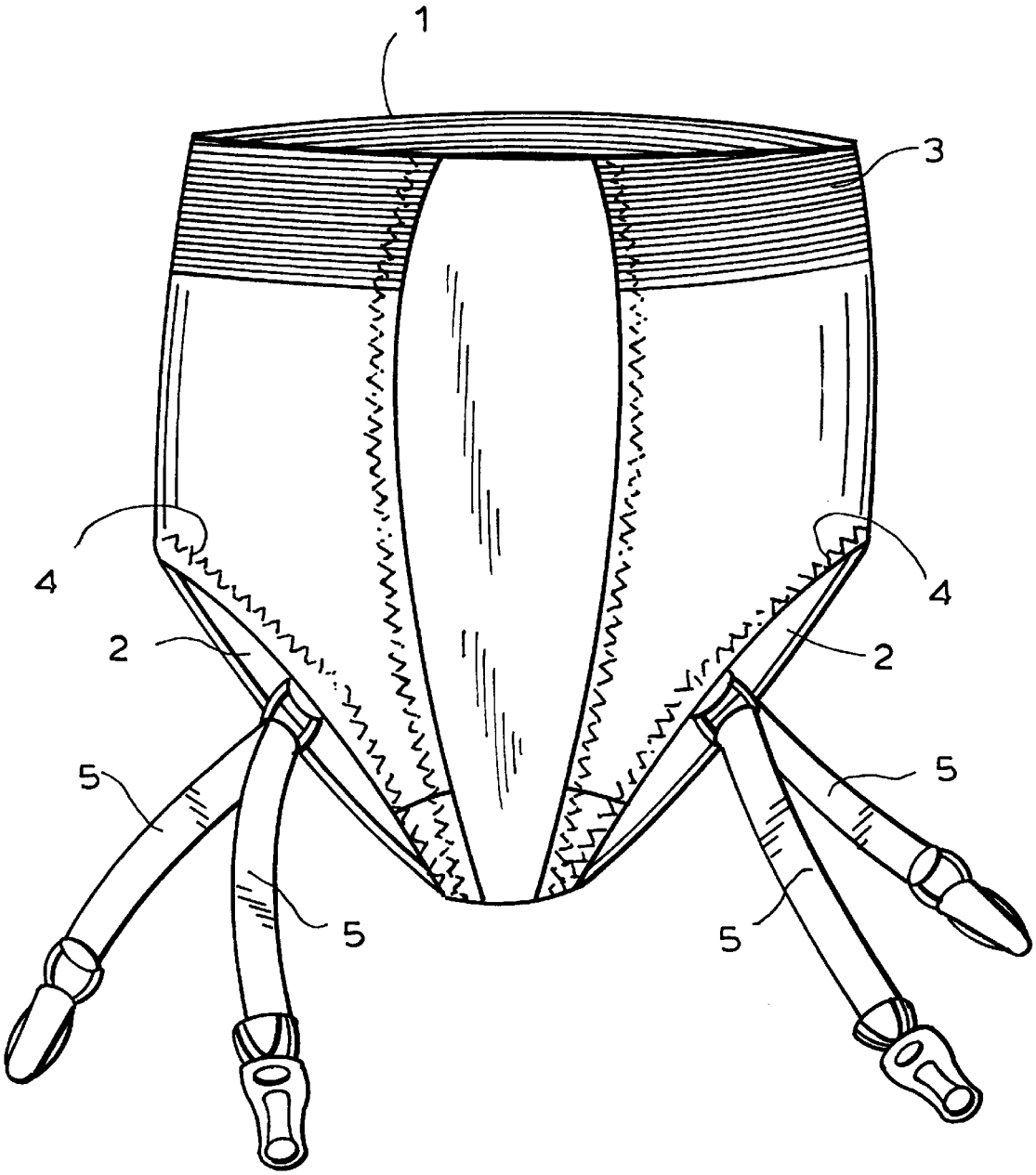
FIG. 6 PRIOR ART
FIG. 6 is a front perspective view of a prior art undergarment.
Figure 7:
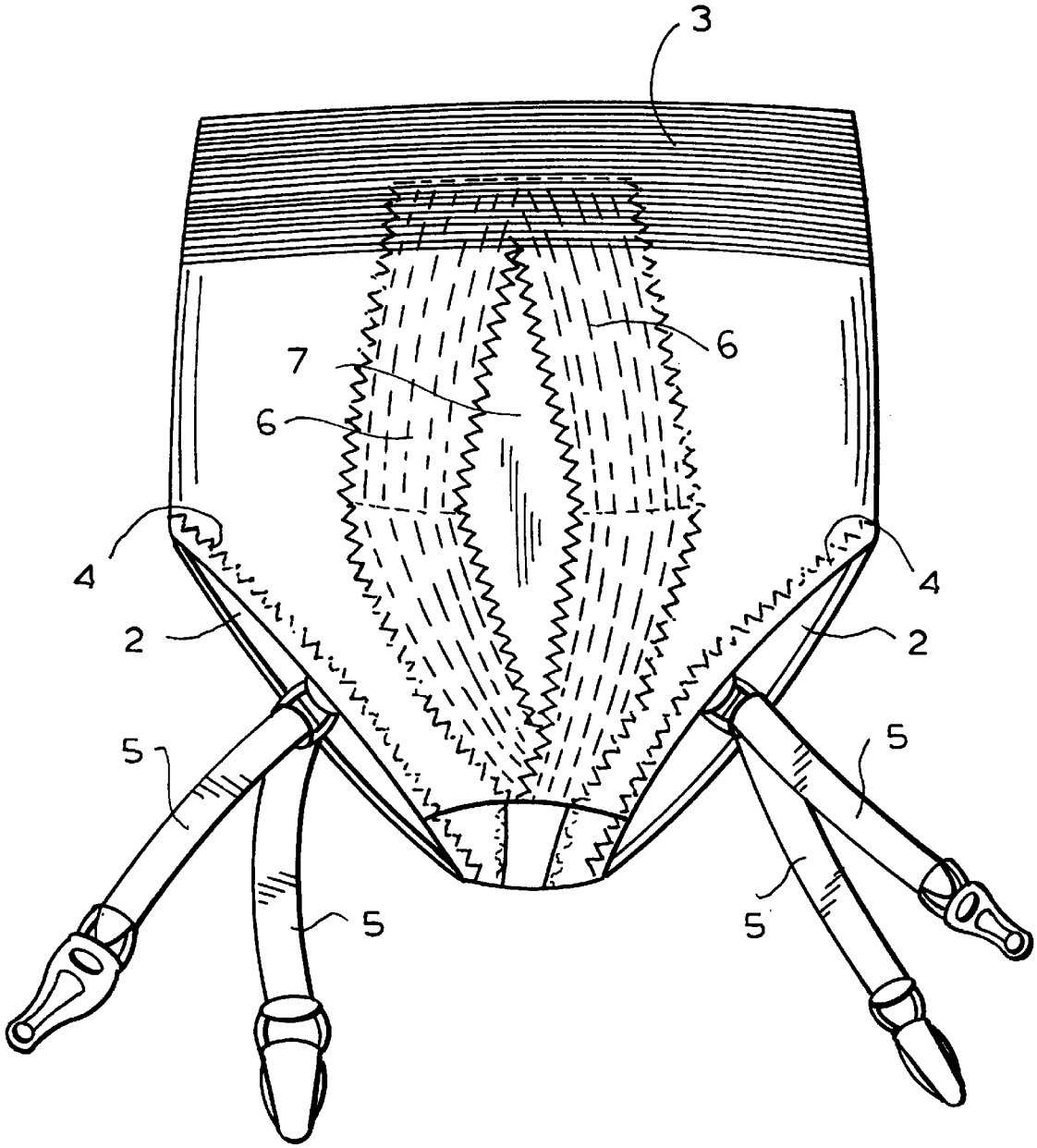
FIG. 7 PRIOR ART
FIG. 7 is a rear perspective view of the prior art undergarment shown in FIG. 6.

FIG. 5 shows the fabric panels splayed out and unassembled. The panels are sewn together so as to form the inventive undergarment 10 as shown in FIGS. 1–4. As described above, the fabric panels comprise an elastic fabric that includes lycra. In accordance with the preferred embodiment, the fabric panels can stretch in all directions so that the wearer is comfortable and has a high degree of freedom of movement, while the inventive undergarment 10 firms and supports the mid-section and thighs of the body. Each buttock support panel 22 includes a first section 24 and a second section 36 which has a stretch direction along its longitudinal direction, while having a non-dash stretch direction perpendicular to the longitudinal direction. By this construction, the buttocks support panels are appropriately enabled to confine the buttocks of the wearer, while allowing for comfort and a high degree of movement. Also, the waist-band and the leg-bands are comprised of a material having a longitudinal stretch direction, and a non-stretch direction perpendicular to the longitudinal. Thus, the waist-band and leg-bands are effective for shaping and supporting the body of the wearer, and co-act with the fabric panels and the buttocks support panels to obtain an overall firmer and more desirable appearance.

The central fabric panel 28 includes a front section 36, a crotch section 38 and a back section 40. The first section 24 and the second section 26 are sewn to the back section 40 so that the pair of elastic buttock support panels 22 co-act to support and shape the buttocks of the wearer. The elastic buttock support panels 22 are also sewn to a respective leg fabric panel 34, to which is sewn the corresponding wider elastic leg section 30 so that the elastic buttock support panels 22 co-act with the elastic leg bands 20 to shape the buttocks and thighs of the wearer. The crotch panel 42 is fixed to the crotch section 38 of the central fabric panel 28, to maintain the integrity and comfort of the undergarment 10. A pair of side fabric panels 44 are sewn in place, as shown in FIG. 1, to complete the undergarment 10 (as shown in FIGS. 1–3).

INDUSTRIAL APPLICABILITY

The present invention is particularly suitable for application to modern industrial processes. In particular, conventional garment manufacturing processes and materials can be used to provide the inventive body shaping undergarment described herein. While an illustrative embodiment of the invention has been described above, it is, of course, understood that various modifications will be apparent to those of ordinary skill in the art. Such modifications are within the spirit and scope of the invention, which is limited and defined only by the appended claims.

I claim:

1. An undergarment, comprising: a plurality of fabric panels fixed together to form an undergarment having a front and a back and defining a first leg opening, a second leg opening and a waist opening; an elastic waist band disposed around at least a portion of a circumference of the waist opening; a first and a second elastic leg band respectively disposed around at least a portion of a circumference of the first leg opening and the second leg opening; said first and said second elastic leg band each comprises a wider elastic leg panel disposable during use for elastically confining substantially an inner and back portion of a respective thigh of the wearer and a thinner elastic leg panel disposable during use for elastically confining substantially a side portion of the respective thigh of the wearer; and a pair of elastic buttock support panels fixed to the undergarment and disposed so that each elastic buttock support panel elastically supports a respective buttock of a wearer, each said elastic buttock support panel being configured and dimensioned to lift and support the respective buttock of the wearer, the pair of elastic buttock support panels being spaced apart and integrally fixed to a same central fabric panel of the plurality of fabric panels so that the pair of elastic buttock support panels co-act to lift and support the buttocks of the wearer, each of the pair of elastic buttock support panels including a first section disposed at the back of the garment and oriented having a longitudinal direction extending substantially from a back portion of the waist opening outwardly towards a respective leg opening and a second section extending from an end of the first section closest to the leg opening and sloping inwardly towards a symmetrical center line of the garment.

2. An undergarment according to claim 1; wherein at least one of the plurality of fabric panels comprises an elastic material.

3. An undergarment according to claim 1; wherein at least the central fabric panel of the plurality of fabric panels comprises an elastic material.

4. An undergarment according to claim 1; wherein each of the pair of elastic buttock support panels is disposed at the back of the garment and oriented having a longitudinal direction extending substantially from a back portion of the waist opening outwardly towards a respective leg opening, each of the pair of elastic buttock support panels comprising an elastic fabric having a stretching direction along the longitudinal direction and a non-stretching direction perpendicular to the longitudinal direction so as to be effective during use to shape the respective buttock of the wearer by elastically supporting the respective buttock in the stretching direction and constrainingly supporting the respective buttock in the non-stretching direction.

5. An undergarment according to claim 1; wherein a first end of each of the pair of elastic buttock support panels is fixed to the elastic waist band so that the elastic waist band supports each respective buttocks through each of the pair of elastic buttock support panels.

6. An undergarment according to claim 1; wherein the central fabric panel comprises an elastic material for elastically supporting the buttocks of the wearer so that the central fabric panel and the pair of elastic buttock support panels co-act to lift and support the buttocks of the wearer.

7. An undergarment configured as a panty girdle, comprising: a plurality of fabric panels fixed together to form an undergarment having a front and a back and defining a first leg opening, a second leg opening and a waist opening; an elastic waist band disposed around at least a portion of a circumference of the waist opening; a first and a second elastic leg band respectively disposed around at least a portion of a circumference of the first leg opening and the second leg opening; said first and said second elastic leg band each comprises a wider elastic leg panel disposable during use for elastically confining substantially an inner and back portion of a respective thigh of the wearer and a thinner elastic leg panel disposable during use for elastically confining substantially a side portion of the respective thigh of the wearer; and a pair of elastic buttock support panels fixed to the undergarment and disposed so that each elastic buttock support panel elastically supports a respective buttock of a wearer, each said elastic buttock support panel comprising a first section disposed at the back of the garment and oriented having a longitudinal direction extending substantially from a back portion of the waist opening outwardly towards a respective leg opening and a second section extending from an end of the first section closest to the leg opening and at a downward sloping angle inwardly towards a symmetrical center line of the garment, the pair of elastic buttock support panels being spaced apart and integrally fixed to a same central fabric panel comprising an elastic material for elastically supporting the buttocks of the wearer so that the central fabric panel and the pair of elastic buttock support panels co-act to lift and support the buttocks of the wearer.

8. An undergarment according to claim 7; wherein at least one of the plurality of fabric panels comprises an elastic material.

9. An undergarment according to claim 7; wherein each of the pair of elastic buttock support panels is disposed at the back of the garment and oriented having a longitudinal direction extending substantially from a back portion of the waist opening outwardly towards a respective leg opening, each of the pair of elastic buttock support panels comprising an elastic fabric having a stretching direction along the longitudinal direction and a non-stretching direction perpendicular to the longitudinal direction so as to be effective to shape the respective buttock of the wearer by elastically supporting the buttock in the stretching direction and constrainingly supporting the buttock in the non-stretching direction.

10. An undergarment according to claim 7; wherein a first end of each of the pair of elastic buttock support panels is fixed to the elastic waist band so that the elastic waist band supports each respective buttocks through each of the pair of elastic buttock support panels.

11. An undergarment, comprising: a plurality of fabric panels fixed together to form an undergarment having a front and a back and defining a first leg opening, a second leg opening and a waist opening; an elastic waist band disposed around at least a portion of a circumference of the waist opening; a first and a second elastic leg band respectively disposed around at least a portion of a circumference of the first leg opening and the second leg opening; said first and said second elastic leg band each comprises a wider elastic leg panel disposable during use for elastically confining substantially an inner and back portion of a respective thigh of the wearer and a thinner elastic leg panel disposable during use for elastically confining substantially a side portion of the respective thigh of the wearer; and a pair of elastic buttock support panels fixed to the undergarment and disposed so that each elastic buttock support panel elastically supports a respective buttock of a wearer, the pair of elastic buttock support panels being integrally fixed to a same fabric panel of the plurality of fabric panels and each one of the pair of elastic buttock support panels being spaced apart and integrally fixed to a respective same fabric panel of the plurality of fabric panels as the first elastic leg band and the second elastic leg band so that the pair of elastic buttock support panels and the first elastic leg band and the second elastic leg band co-act to lift and support the buttocks of the wearer, each of the pair of elastic buttock support panels including a first section disposed at the back of the garment and oriented having a longitudinal direction extending substantially from a back portion of the waist opening outwardly towards a respective leg opening and a second section extending from an end of the first section closest to the leg opening and at a downward and inwardly sloping angle towards a symmetrical center line of the garment.

12. An undergarment according to claim 11; wherein at least one of the plurality of fabric panels comprises an elastic material.

13. An undergarment according to claim 11; wherein each of the pair of elastic buttock support panels is disposed at the back of the garment and oriented having a longitudinal direction extending substantially from the waist opening towards a respective leg opening, each of the pair of elastic buttock support panels comprising an elastic fabric having a stretching direction along the longitudinal direction and a non-stretching direction perpendicular to the longitudinal direction so as to be effective to shape the respective buttock of the wearer by elastically supporting the buttock in the stretching direction and constrainingly supporting the buttock in the non-stretching direction.

14. An undergarment according to claim 11; wherein a first end of each of the pair of elastic buttock support panels is fixed to the elastic waist band so that the elastic waist band supports each respective buttocks through each of the pair of elastic buttock support panels.

15. An undergarment according to claim 11; wherein the central fabric panel comprises an elastic material for elastically supporting the buttocks of the wearer so that the central fabric panel, the pair of elastic buttock support panels, the first elastic leg band and the second elastic leg band co-act to lift and support the buttocks of the wearer.

* * * * *